US005299596A

United States Patent [19]

D'Alessandro

[11] Patent Number: 5,299,596

[45] Date of Patent: Apr. 5, 1994

[54] SEWER CHIMNEY SYSTEM

[76] Inventor: Nicholas D'Alessandro, 1183 Washington St., Canton, Mass. 02021

[21] Appl. No.: 107,955

[22] Filed: Aug. 17, 1993

[51] Int. Cl.[5] ..... F16L 5/00

[52] U.S. Cl. ..... 137/363; 52/19

[58] Field of Search ..... 137/363; 405/41, 52; 52/169.5, 727, 19, 20

[56] References Cited

U.S. PATENT DOCUMENTS

| | | | |
|---|---|---|---|
| 320,002 | 6/1885 | Ricketts | 137/363 X |
| 1,905,856 | 6/1930 | Haase et al. | 52/20 X |
| 3,633,219 | 1/1972 | Byrd | 137/363 |
| 4,102,088 | 7/1978 | Keller et al. | 52/20 |
| 4,243,068 | 1/1981 | Sugda et al. | 137/363 |
| 4,566,483 | 1/1986 | Ditcher | 137/363 X |
| 4,871,084 | 10/1989 | Robbins | 137/363 |

*Primary Examiner*—Martin P. Schwadron
*Assistant Examiner*—Kevin L. Lee
*Attorney, Agent, or Firm*—Joseph S. Iandiorio

[57] ABSTRACT

A sewer chimney system for stabilizing and protecting a chimney pipe interconnecting a service pipe and a main sewer line includes a base for bridging a main sewer line, the base having a hole for accommodating the chimney pipe rising from the main sewer line; a hollow casing vertically mounted on the base and having a lower open end aligned with the hole in the base for receiving the chimney pipe; and having an upper open end for receiving fill about the chimney pipe, the case including a lateral hole for receiving a service pipe for interconnection with the chimney pipe, and a device for attaching the hollow casing to the base for securing it during filling of the casing and during backfilling around the casing.

12 Claims, 5 Drawing Sheets

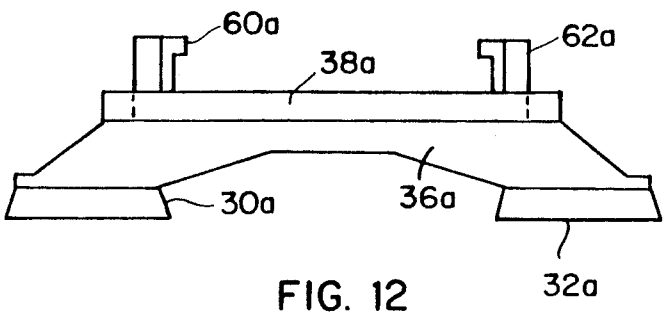
FIG. 12
FIG. 10
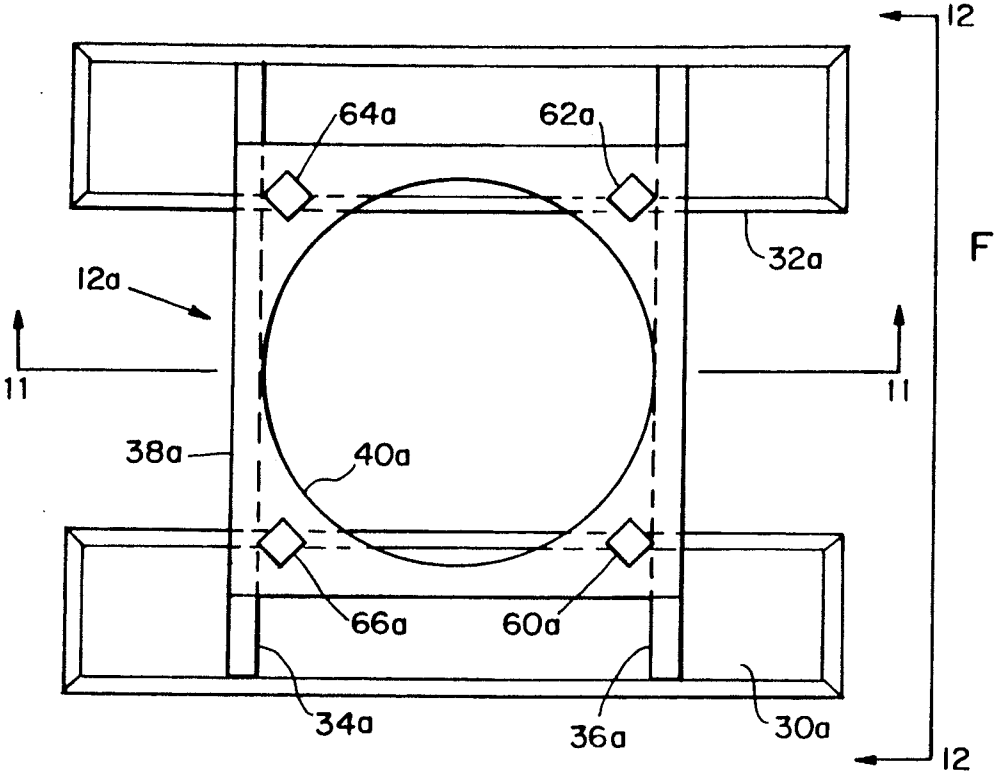
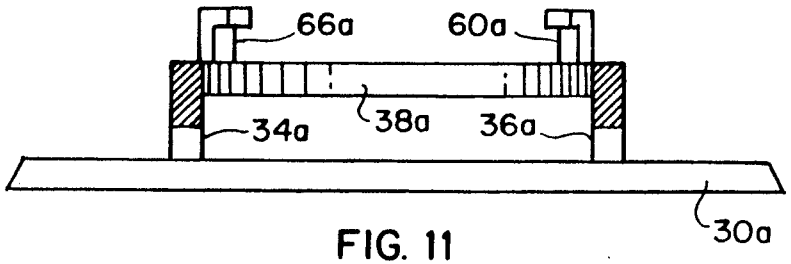
FIG. 11

SEWER CHIMNEY SYSTEM

FIELD OF INVENTION

This invention relates to an improved sewer chimney system for stabilizing and protecting a chimney pipe interconnecting a service pipe and a main sewer line.

BACKGROUND OF INVENTION

Sewer chimney systems are used to surround and protect the generally vertical chimney pipe which rises from a "wye" or "tee" connection at the generally horizontal main sewer line and interconnects at another "wye" or "tee" with the generally horizontal service pipe from a home or business building. One type of chimney system in current use is comprised of a circular cardboard form which is placed around the chimney pipe into which fresh concrete is poured. The fresh concrete is also placed around the "wye" or "tee" below, thereby creating a solid mass of concrete bearing directly on the sewer main. Concrete weighs about 150 pounds per cubic foot as compared to sand or gravel, which weighs about 100 pounds per cubic foot. Most leaks are found to occur at the chimney locations due to differential settling caused by the differential loading.

Fresh concrete, of course, is obtained by calling a concrete mixing plant to deliver the concrete by truck, or the concrete is mixed on the job site with a portable mixer, or by hand. In either case the process is very time consuming and expensive. Another disadvantage is the fact that no backfilling of earth is permitted around this chimney system until the fresh concrete has hardened, which usually means at least the next day, thus also causing a delay in progress.

A second sewer chimney system currently in use consists of a chimney pipe cast within a precast concrete section. The system consists of a precast base section, precast riser section of two, three or four foot height, and a precast top section which consists of the "wye" or "tee" which receives the sewer service pipe. The sections are stacked on each other and bolted together to prevent leakage and toppling.

Once installed, the system can be backfilled with earth. There are several problems associated with such a system. Several pieces of heavy construction equipment are used for the process. On delivery to the job site a front-end loader with operator and a laborer is needed to unload the concrete sections and deposit them at a storage site. The concrete sections are once again picked up at a later date with a front end loader with an operator, a laborer, and possibly a truck and driver for delivery to the work site. The backhoe, which is generally used to excavate the sewer trench, is then used to lift the concrete sections and place them into position over the "wye" or "tee". The sewer main installation is slowed down considerably because the backhoe which should be digging is now installing the precast chimney. A crew of six to eight men plus the equipment is virtually brought to a halt during this phase.

Leaks are a significant problem with this system due to the integration of the chimney pipe within the concrete sections.

The base portion of this precast system, which supports the riser sections and top section, straddles the sewer main. However, this system is capable of causing failure to the sewer main if settlement of the precast concrete sections occurs. Even though the base section straddles the sewer main and is initially set a few inches above the top of the sewer main, settlement due to the excessive weight can cause forces to be exerted on the "wye" or "tee" which is making direct contact with it.

SUMMARY OF INVENTION

It is therefore an object of this invention to provide an improved sewer chimney system for stabilizing and protecting a chimney pipe.

It is a further object of this invention to provide such an improved sewer chimney system which is lighter in weight and less expensive.

It is a further object of this invention to provide such an improved sewer chimney system which is simpler, easier and faster to make and to install.

It is a further object of this invention to provide such an improved sewer chimney system which requires no delay in installation progress.

It is a further object of this invention to provide such an improved sewer chimney system which does not require heavy machinery to transport or install.

It is a further object of this invention to provide such an improved sewer chimney system which uses fill similar to the surrounding fill and avoids differential loading of the sewer main in the area of the chimney pipe.

The invention results from the realization that a truly simple, lightweight, inexpensive, easy to install sewer chimney system can be achieved using a base for bridging the main sewer line and a hollow casing rising from the base and surrounding the chimney pipe to permit fill to be disposed between the casing and chimney pipe which fill is similar in weight to fill disposed about the chimney.

This invention features a sewer chimney system for stabilizing and protecting a chimney pipe interconnecting a service pipe and a main sewer line. There is a base for bridging a main sewer line. The base has a hole for accommodating the chimney pipe rising from the main sewer line. There is a hollow casing vertically mounted on the base and having a lower open end aligned with the hole in the base for receiving the chimney pipe. Its upper open end receives fill about the chimney pipe. The casing includes a lateral hole for receiving a service pipe for interconnection with the chimney pipe. There are means for attaching the hollow casing to the base for securing it during filling of the casing and during backfilling around the casing.

In a preferred embodiment the base may include a pair of spaced footings for disposition on either side of the main sewer line. The base may include a pair of bridge elements spaced from each other and extending from footing to footing over the main sewer line. The base may further include a plate supported by the bridge elements and containing the hole. The base may be integrally formed of the footings, bridge elements, and the plate. The means for attaching the casing to the base may include a plurality of retainer clamps spaced about the hole of the plate. Each retainer clamp may include a vertical riser portion and an inwardly directed horizontal retainer element. The hollow casing may be corrugated, and the means for attaching may include a retainer block conformed to at least one corrugation and constrained by the retainer clamp. The retainer clamps may be integral with the base. The system may include a centering clamp for engaging the upper open end of the casing and the chimney pipe for centering it in the casing. The centering clamp may include a band for surrounding the chimney pipe and a plurality of holding rods threadably engaged with the band for gripping the chimney pipe. The rods may include a stop element for engaging the upper open end of the casing.

DISCLOSURE OF PREFERRED EMBODIMENT

Other objects, features and advantages will occur to those skilled in the art from the following description of a preferred embodiment and the accompanying drawings, in which:

FIG. 10 is a top plan view of an integrally formed base similar to that of FIG. 2;

FIG. 11 is a sectional view taken along line 11—11 of FIG. 10; and

FIG. 12 is a sectional view taken along line 12—12 of FIG. 10.

Figure 1:
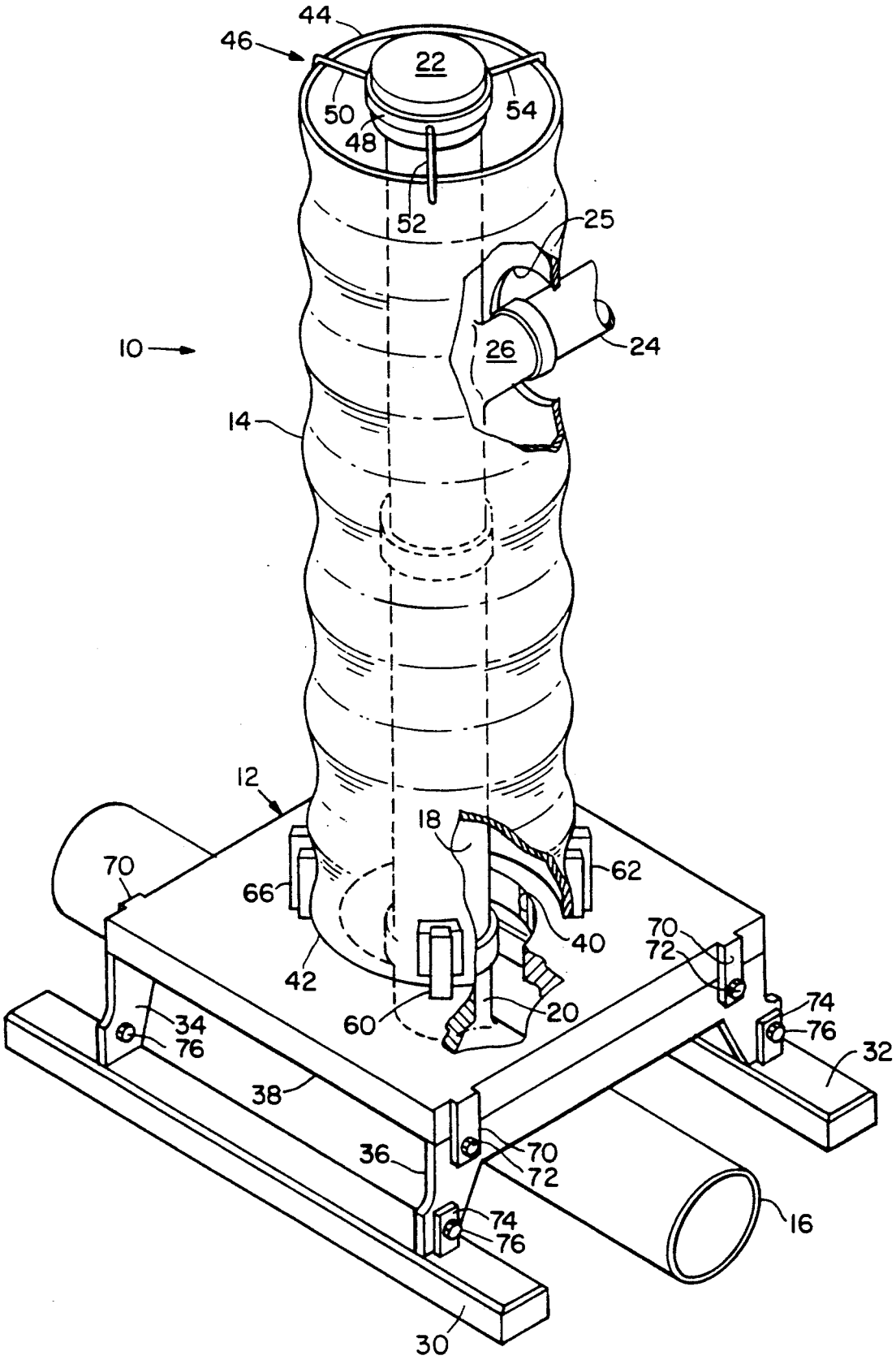
FIG. 1 is an axonometric view with portions broken away of a sewer chimney system according to this invention.

There is shown in FIG. 1 a sewer chimney system 10 according to this invention which includes base 12 and vertically rising chimney casing 14. Casing 14 may be made of any suitable material such as plastic or metal and is conveniently implemented with conventional drainage or sewage pipe such as ADS N-12 pipe manufactured by Advanced Drainage Systems, Inc., which, as shown, is corrugated in form. The ADS pipe is strong enough to support earth loads in the vertical and even in the horizontal position but is much lighter even than the fill used. Base 12 may also be made of any suitable material such as concrete, plastic, or metal such as cast iron. Sewer chimney system 10 sits astride main sewer line 156 and surrounds and protects chimney pipe 18 which rises from main sewer line 16 at "wye" or "tee" connection 20. Chimney pipe 18 is sealed at its upper end by cap 22 and is interconnected through hole 25 in casing 14 with service pipe 24 from a home or business by means of another "wye" or "tee" connection 26. Base 12 includes two footings 30, 32 which extend generally parallel to and spaced from main sewer line 16. A pair of bridge elements 34, 36 straddle main sewer line 16 from footing 30 to footing 32. Plate 38 is mounted on top of bridge elements 34 and 36 and includes a hole 40 communicating with the lower open end 42 of chimney casing 14. The upper open end 44 of chimney casing 14 is centered about chimney pipe 18 by means of centering clamp 46 which includes band 48 that surrounds cap 22 and three threaded rods 50, 52 and 54 whose inner ends engage cap 22 and whose outer ends engage the rim of upper open end 44 of chimney casing 14.

With this construction, chimney pipe 18 is stabilized and protected by casing 14 so that initially fill can be poured between casing 14 and chimney pipe 18 to fill and surround the area between chimney pipe 18 and base 12 as well as between chimney pipe 18 and casing 14. Hole 40 in plate 38 permits the fill introduced at upper hole 44 of casing 14 to fall through to the ground level and surround main sewer line 16 as well as "wye" or "tee" connection 18 at the lower portion of chimney pipe 18. Following this, normal backfill is occasioned whereby similar materials are used to backfill around the outside of casing 14. In this way chimney pipe 18 is stabilized and protected and the weight applied to sewer line 16 is similar over its entire length including the area of interconnection of chimney pipe 18 and "wye" or "tee" connection 20.

Figure 4:
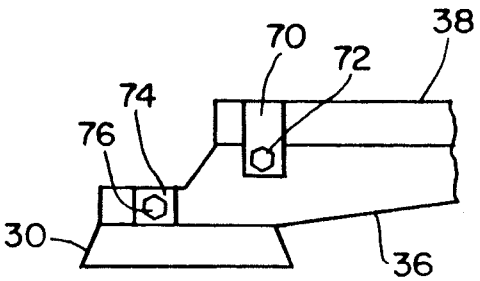
FIG. 4 is a view taken along lines 4—4 of FIG. 2.
Figure 2:
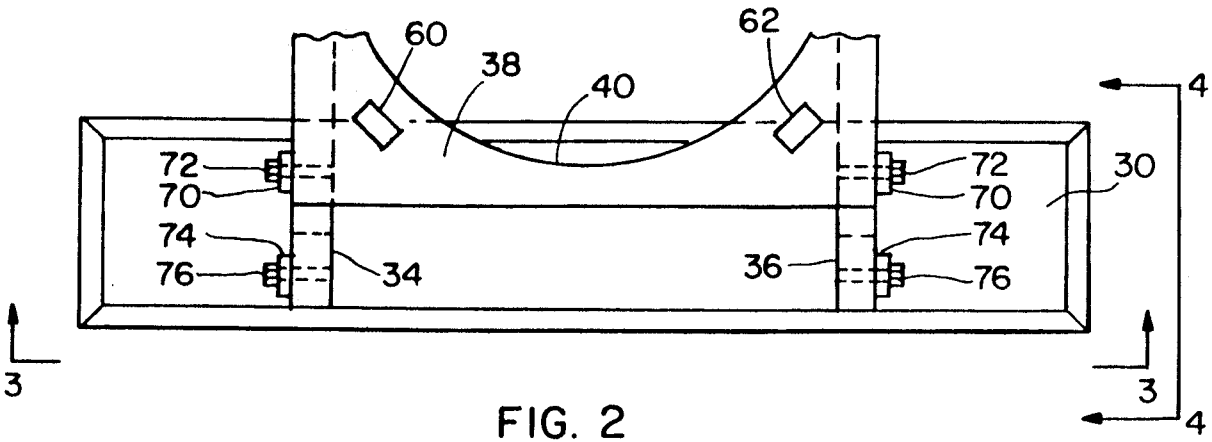
FIG. 2 is a top plan view of a portion of the base of the sewer chimney system shown in FIG. 1.
Figure 3:
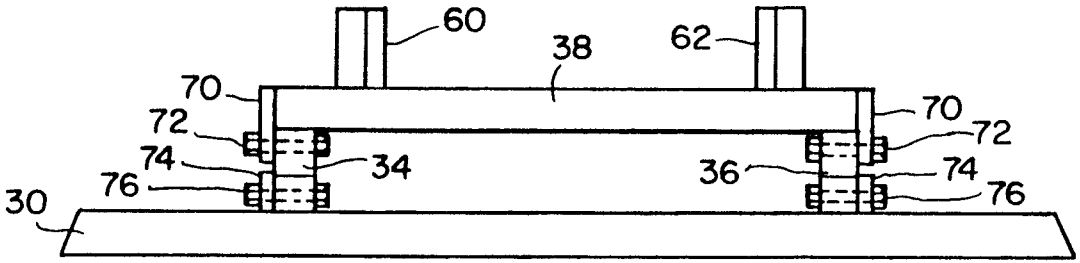
FIG. 3 is a view taken along lines 3—3 of FIG. 2.
Figure 7:
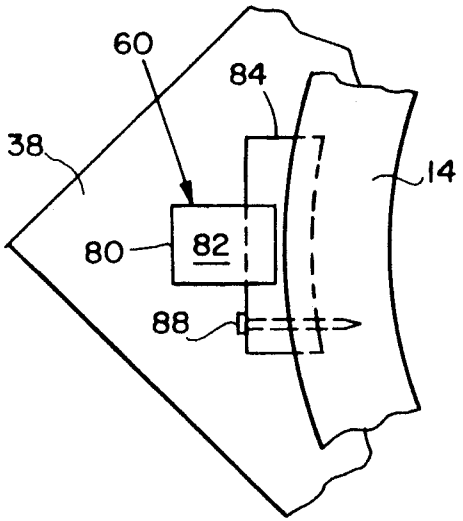
FIG. 7 is a top plan view of the retainer clamp of FIG. 5.
Figure 6:
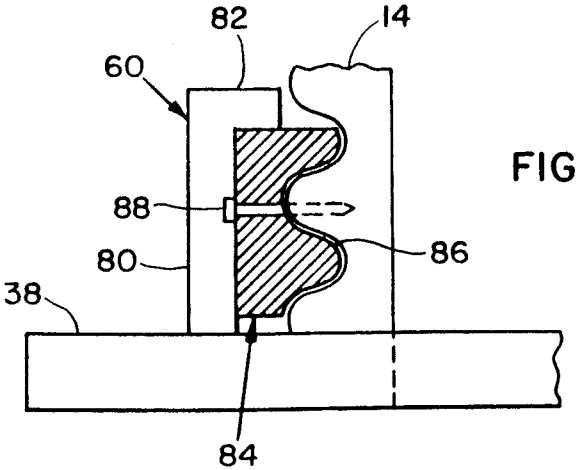
FIG. 6 is a side elevational view of the retainer clamp of FIG. 5.
Figure 5:
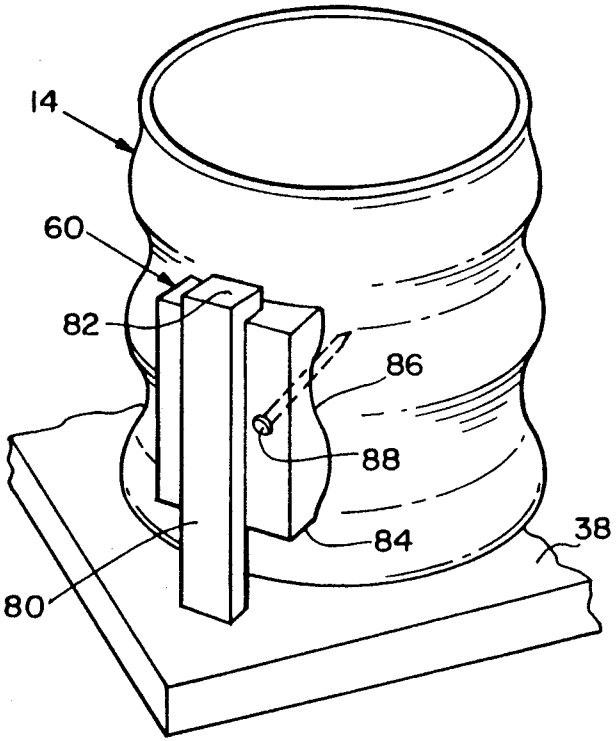
FIG. 5 is an enlarged detail view of a retainer clamp shown in FIG. 1.

Base 12 includes a plurality of retainer clamps 60, 62, 64 (not shown) and 66 which grip and secure casing 14 to plate 38. Footings 30, 32, bridge elements 34, 36, and plate 38 may be separately formed elements. Plate 38 may include four ears 70, shown more clearly in FIGS. 2–4, which employ bolts 72 to attach to bridge elements 34 and 36. Bridge elements 34 and 36 may in turn attach to footings 30 and 32 using four ears 74 and four bolts 76. Each retainer clamp 60, 62, 64 and 66, FIGS. 5–7, may include a vertical riser portion 80 and an inwardly directed horizontal retainer element 82 on top. Retainer block 84 fits against riser 80 and under retainer element 82 so that it is securely held in place while its curved surface 86 conforms to and grips the corrugations of chimney casing 14. A spike 88 may be driven through block 84 to keep it from sliding with respect to retainer clamp 60 and casing 14.

Figure 8:
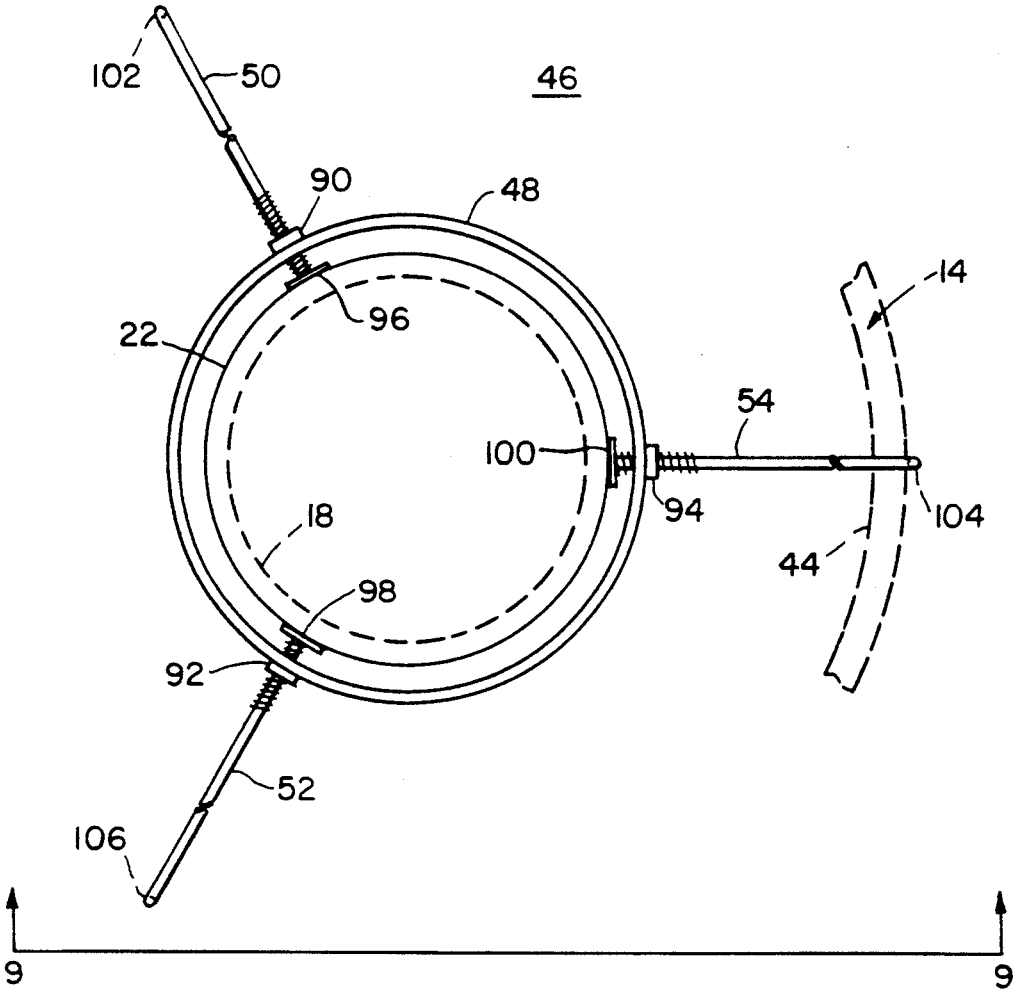
FIG. 8 is a top plan view of the centering clamp of FIG. 1.
Figure 9:
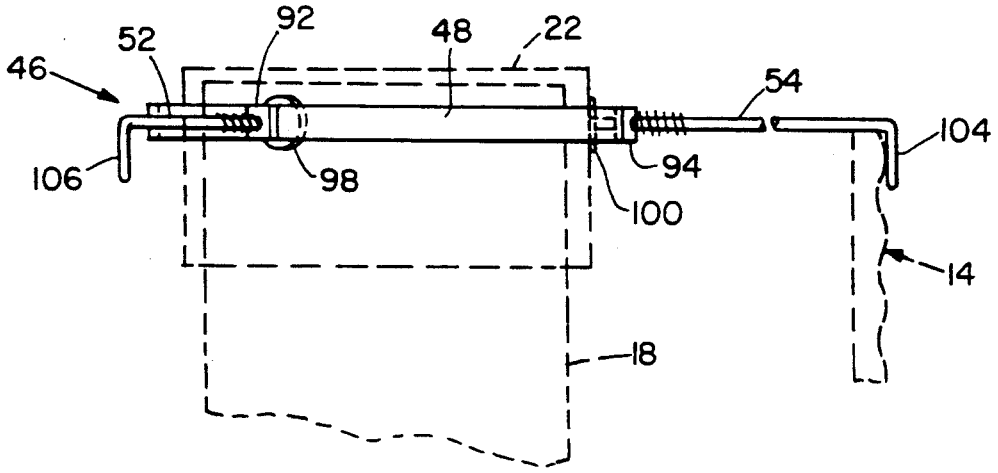
FIG. 9 is a side view of FIG. 8.

Band 48, FIG. 8, of centering clamp 46 includes three threaded bearings 90, 92 and 94, which receive the threaded ends of rods 50, 52 and 54, respectively. At the end of each rod is an enlarged head 96, 98 and 100 which bears on pipe 18 or cap 22 by the action of turning threaded rods in thread bearings 90, 92 and 94. The outer end of each rod includes a downward-extending portion or hook 102, 104 and 106, as better seen in FIG. 9, which extends over and grips casing 14.

Although base 12, FIG. 1, has been depicted as made of individual elements, this is not a necessary limitation of the invention, as base 12*a*, FIGS. 10, 11 and 12, may be integrally formed so that footings 30*a*, 32*a*, bridge elements 34*a* and 36*a*, and plate 38*a* are all formed as a single unit, for example as an iron, plastic or cement casting.

Although specific features of this invention are shown in some drawings and not others, this is for convenience only as each feature may be combined with any or all of the other features in accordance with the invention.

Other embodiments will occur to those skilled in the art and are within the following claims:

What is claimed is:

1. A sewer chimney system for stabilizing and protecting a chimney pipe interconnecting a service pipe and a main sewer line, comprising:

a base for bridging a main sewer line, said base having a hole for accommodating the chimney pipe rising from the main sewer line;

a hollow casing vertically mounted on said base and having a lower open end aligned with said hole in said base for receiving the chimney pipe and having an upper open end for receiving fill about the chimney pipe; said casing including a lateral hole for receiving a service pipe for interconnection with said chimney pipe; and means for attaching said hollow casing to said base for securing it during filling of the casing and during backfilling around the casing.

2. The sewer chimney system of claim 1 in which said base includes a pair of spaced footings for disposition on either side of the main sewer line.

3. The sewer chimney system of claim 2 in which said base further includes a pair of bridge elements spaced from each other and extending from footing to footing over the main sewer line.

4. The sewer chimney system of claim 3 in which said base further includes a plate supported by said bridge elements and containing said hole.

5. The sewer chimney system of claim 4 in which said base is integrally formed of said footings, said bridge elements and said plate.

6. The sewer chimney system of claim 1 in which said means for attaching includes a plurality of retainer clamps spaced about said hole on said plate.

7. The sewer chimney system of claim 6 in which each said retainer clamp includes a vertical riser portion and an inwardly directed horizontal retainer element.

8. The sewer chimney system of claim 6 in which said hollow casing is corrugated and said means for attaching includes a retainer block conformed to at least one corrugation and constrained by said retainer clamp.

9. The sewer chimney system of claim 6 in which said retainer clamps are integral with said base.

10. The sewer chimney system of claim 1 further including a centering clamp for engaging the upper open end of said casing and the chimney pipe for centering it in said casing.

11. The sewer chimney system of claim 10 in which said centering clamp includes a band for surrounding said chimney pipe, and a plurality of holding rods threadably engaged with said band for gripping said chimney pipe.

12. The sewer chimney system of claim 11 in which said rods include a stop element for engaging the upper open end of said casing.

* * * * *